US005350163A

United States Patent [19]

Lichtenberg

[11] Patent Number: 5,350,163

[45] Date of Patent: Sep. 27, 1994

[54] CLAMP WITH PIVOTING AND SLIDING JAWS

[76] Inventor: Wilfried Lichtenberg, 3/16 Stokes Street, Darwin, NT 0820, Australia

[21] Appl. No.: 923,961

[22] PCT Filed: Feb. 8, 1991

[86] PCT No.: PCT/AU91/00046

§ 371 Date: Sep. 16, 1992

§ 102(e) Date: Sep. 16, 1992

[87] PCT Pub. No.: WO91/12114

PCT Pub. Date: Aug. 22, 1991

[30] Foreign Application Priority Data

Feb. 9, 1990 [AU] Australia ..... PJ8568

[51] Int. Cl.[5] ..... B25B 1/00

[52] U.S. Cl. ..... 269/156; 269/217; 269/233; 269/258; 269/266; 269/268; 269/902

[58] Field of Search ..... 269/249, 156, 266, 268, 269/902, 217, 233, 305, 45, 910, 258; 294/96, 102.1

[56] References Cited

U.S. PATENT DOCUMENTS

| | | | |
|---|---|---|---|
| 413,780 | 10/1889 | Griswold | 254/398 |
| 1,349,963 | 8/1920 | Jerrim | 269/266 |
| 2,541,605 | 2/1951 | Ohlsson | 269/156 |
| 2,698,550 | 1/1955 | Hill | 269/249 |
| 2,754,528 | 7/1956 | Pinkerton | 269/217 |
| 2,806,380 | 9/1957 | Martin | 254/134.3 PA |
| 2,850,931 | 9/1958 | Conway | 269/233 |
| 3,190,216 | 6/1965 | Keller | 269/233 |
| 3,199,840 | 8/1965 | Lindsey | 254/134.3 PA |
| 4,157,819 | 6/1979 | Meyer . | |
| 4,579,322 | 4/1986 | Schwarz | 269/274 |
| 4,767,110 | 8/1988 | Yang . | |

FOREIGN PATENT DOCUMENTS

| | | |
|---|---|---|
| 24030 | of 1925 | Australia . |
| 2164877 | 4/1986 | United Kingdom . |

*Primary Examiner*—Robert C. Watson

*Attorney, Agent, or Firm*—Ostrolenk, Faber, Gerb & Soffen

[57] ABSTRACT

A clamping member (11) for a wood clamp (10) is provided and comprises two spaced engaging elements (14, 15), each shaped as right oval cylinders. The engaging elements are rotatably mounted to a support plate (17) and are arranged to slide relative to support plate in respective slots (16) which converge. A workpiece is arranged to be clamped between the engaging elements when it is moved in the direction in which the slots converge as movement of the workpiece causes the engaging elements to slide in the converging slots thus further gripping the workpiece and also rotate until such time as the engaging elements clamp the workpiece and prevent further movement of the workpiece.

23 Claims, 5 Drawing Sheets

CLAMP WITH PIVOTING AND SLIDING JAWS

TECHNICAL FIELD

The present invention relates to a clamping member and in particular to a clamping member for holding rigid work pieces. The invention has been developed primarily for use in a wood clamp and the invention is hereinafter described in such context. However, it would be appreciated that the invention is not limited to this particular field of use and may be used for supporting or clamping any of a range of rigid work pieces.

BACKGROUND ART

In the past, various clamping arrangements have been proposed for clamping or supporting work pieces. A commonly used clamping arrangement is the vice which consists of two plates which are drawn together by a lead screw. While the vice is effective for holding a single work piece, or for holding parallel work pieces, it is not versatile in that the device cannot adequately cater for irregular shaped work pieces.

U.S. Pat. No. 4,767,110 (Yang) discloses a modified vice arrangement to cater for irregular shaped work pieces. Yang discloses a work table incorporating first and second vice jaws, each of which incorporate a series of connection holes. At least three clamping claws are removably mounted to the connection holes of the vice jaws, and are arranged such that one of the claws is located in one of the jaws where the other two claws are located in the other jaw. The claws are mounted to the connection holes via shanks and these shanks are eccentrically located on the claws. In this way, the respective claws can be independently moved out of respective connection holes and inserted in a different connection hole to provide longitudinal adjustability of the claws independent of the vice jaws. The claws are further arranged to rotate about their respective shanks to provide individual angular adjustability.

With the arrangement as disclosed in Yang, a work piece is clamped by firstly locating the claws in appropriate connection holes such that they are as close to the work piece as possible. The vice jaws are then brought together and at least some of the claws are rotated until such time that all the individual claws apply a force and clamp the work piece. To assist in rotation of the claws, each claw is provided with a push handle.

While the Yang patent does enable greater flexibility of the type of work pieces which can be clamped, it does have the limitation that it is required to be located on a work bench and furthermore rapid adjustment of the claws is not possible. Furthermore, the actual clamping of the work piece is difficult in that it is necessary to bring the vice jaws together, while simultaneously applying pressure on each push handle to apply a force normal to the contact surface to ensure that the claws grip the work piece properly. This applied normal force is required if there is not sufficient frictional force between the work piece and the claws to prevent the work piece from merely sliding between the two clamping claws, rather than gripping the work piece and rotating to effect clamping.

DISCLOSURE OF INVENTION

The present invention aims at providing a clamping member which ameliorates at least some of the above problems.

Accordingly, in a first aspect the present invention provides a clamping member comprising a support plate and a pair of engaging elements, the support plate incorporating a pair of converging slots, and each engaging element incorporating a wall surface of which at least a portion is arcuate in shape and is formed from a non-slip material, a respective one of the engaging elements being captured in a respective one of the slots and each engaging element being arranged to extend outwardly from a first side of the support plate such that the wall surfaces of the engaging elements are opposed to each other, each engaging element being slidable in its respective slot and each engaging element being mounted to the support plate via low friction bearings such that each engaging element can freely rotate relative to the support plate about an axis of rotation, thereby enabling the distance between the opposing wall surfaces to be varied by sliding of the engaging elements in their respective slots and wherein rotation of the engaging elements via the low friction bearings from a first position to a second position causes the distance between the opposing wall surfaces to be reduced, the clamping member being arranged in use to clamp a work piece by locating the work piece between the opposing wall surfaces of the engaging elements which are adjusted to contact the work piece in the first position, the work piece thereafter being moved in the direction of converging of the slots causing the engaging elements to be biased to slide with the work piece such that the engaging elements apply additional pressure on the work piece, and that further movement of the work piece in the direction of converging of the slots causes rotation of the engaging elements to the second position wherein the engaging elements clamp the work piece and prevent further movement of the work piece in the direction of converging of the slots.

In a second aspect the present invention provides a clamping member as above described which further comprises a guide arranged to contact the engaging elements and move the engaging elements in their respective slots without preventing rotation of the engaging elements relative to the support plate from the first to the second position.

In a third aspect the present invention relates to a method of clamping a work piece.

Preferably each engaging element is oval shaped in cross section perpendicular to its axis of rotation. Alternatively, each engaging element is shaped as a modified right triangle in cross section perpendicular to its axis of rotation, the modified right triangle having laterally curved faces in the direction of one lateral edge to the opposite edge and preferably each laterally curved faced is formed from a different material to thereby provide three faces of different hardness, flexibility or surface texture.

Preferably the clamping member is used in conjunction with a clamp which incorporates a second clamping member which is arranged to provide a force on the work piece to move said work piece in the direction of converging of the slots. The second clamping member is able to provide a force on the work piece to move the work piece in the direction of converging of the slots by being able to be moved relative to the engaging elements in a direction away or towards the engaging elements. Movement of the second clamping member relative to the engaging elements in a direction towards the engaging elements cause the work piece to move in said direction of converging.

Preferably the second clamping member comprises a plate connected to a threaded rod which is located in a corresponding threaded hole connected to the support frame. In this way the plate of the second clamping means is capable of linear movement with respect to the support frame by rotation of the threaded rod.

Alternatively, the second clamping member comprises a similar arrangement as that of the first clamping member. In this arrangement the supports of both the first and second clamping members are interconnected by way of a coupling element which enable relative movement of the first and second clamping members. The coupling element may consisting of a rod having a thread on its outer surface which is arranged to be received in a sleeve having a corresponding thread on its inner surface. In this way rotation of the sleeve relative to the rod causes linear movement of the first clamping member relative to the second clamping member.

An advantage of a preferred embodiment of the present invention is that as the engaging elements are slidably mounted to the support, quick and easy adjustment of the position of the engaging element is possible. Furthermore during clamping of the work piece, the lateral force applied by the engaging elements on the work piece is increased as the engaging elements are biased to converge by sliding in the converging slots. With this additional lateral force provided by the sliding of the engaging element, it increases the grip for the engaging elements to rotate without slipping and to therefore firmly clamp the work piece. In this way, the engaging elements of the preferred embodiment of the present invention can usually grip the work piece solely through the movement of the work piece and an external torque is not required to be applied to the engaging surface to ensure that adequate grip occurs between the work piece and the engaging elements to effect rotation of the engaging elements.

BRIEF DESCRIPTION OF DRAWINGS

Notwithstanding any other forms that may fall within its scope, the preferred forms of the invention will now be described by way of example only with reference to the accompanying drawings in which.

MODES FOR CARRYING OUT THE INVENTION

Figure 1:
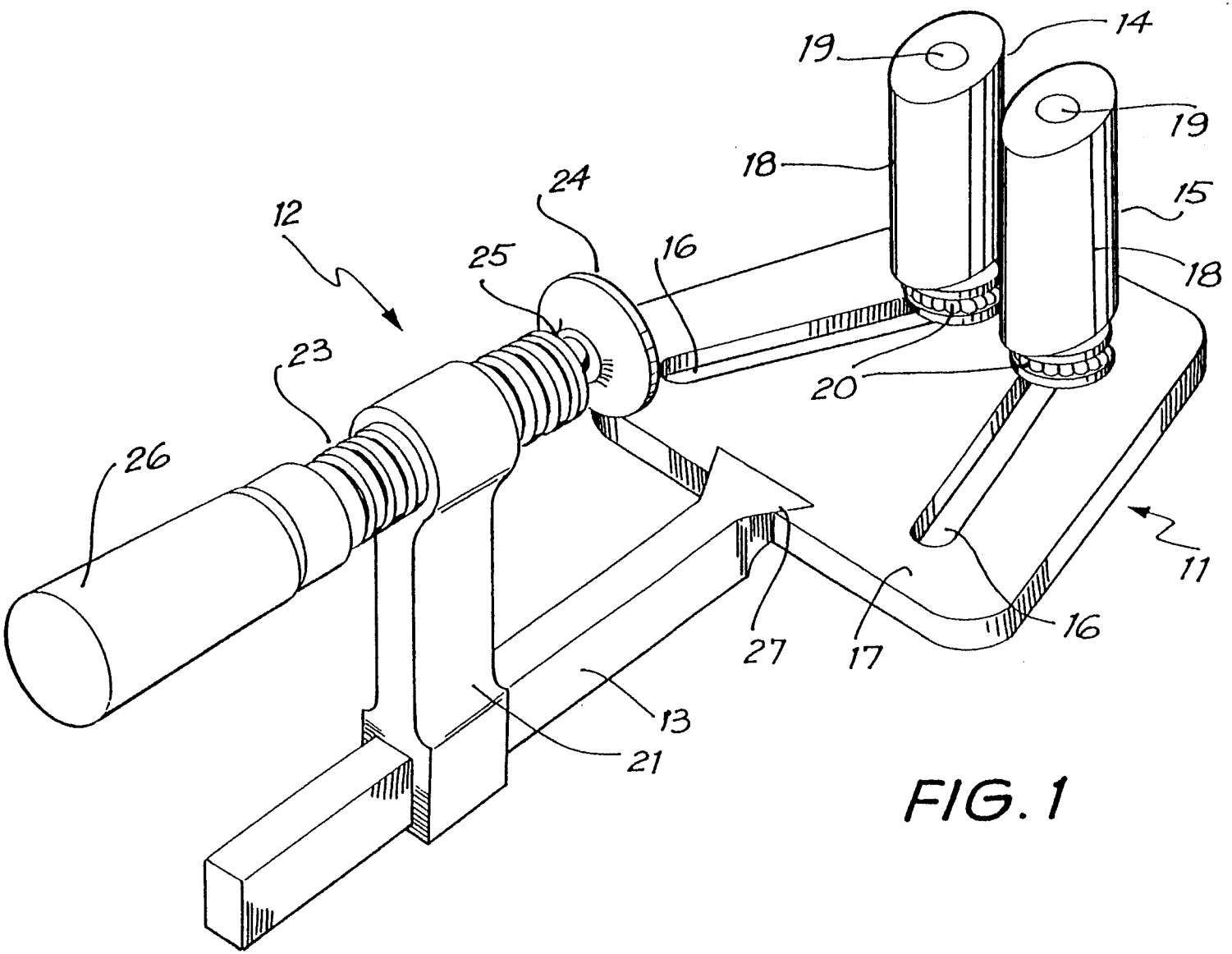
FIG. 1 is a perspective view of a clamp incorporating a clamping member embodying the present invention.
Figure 2:
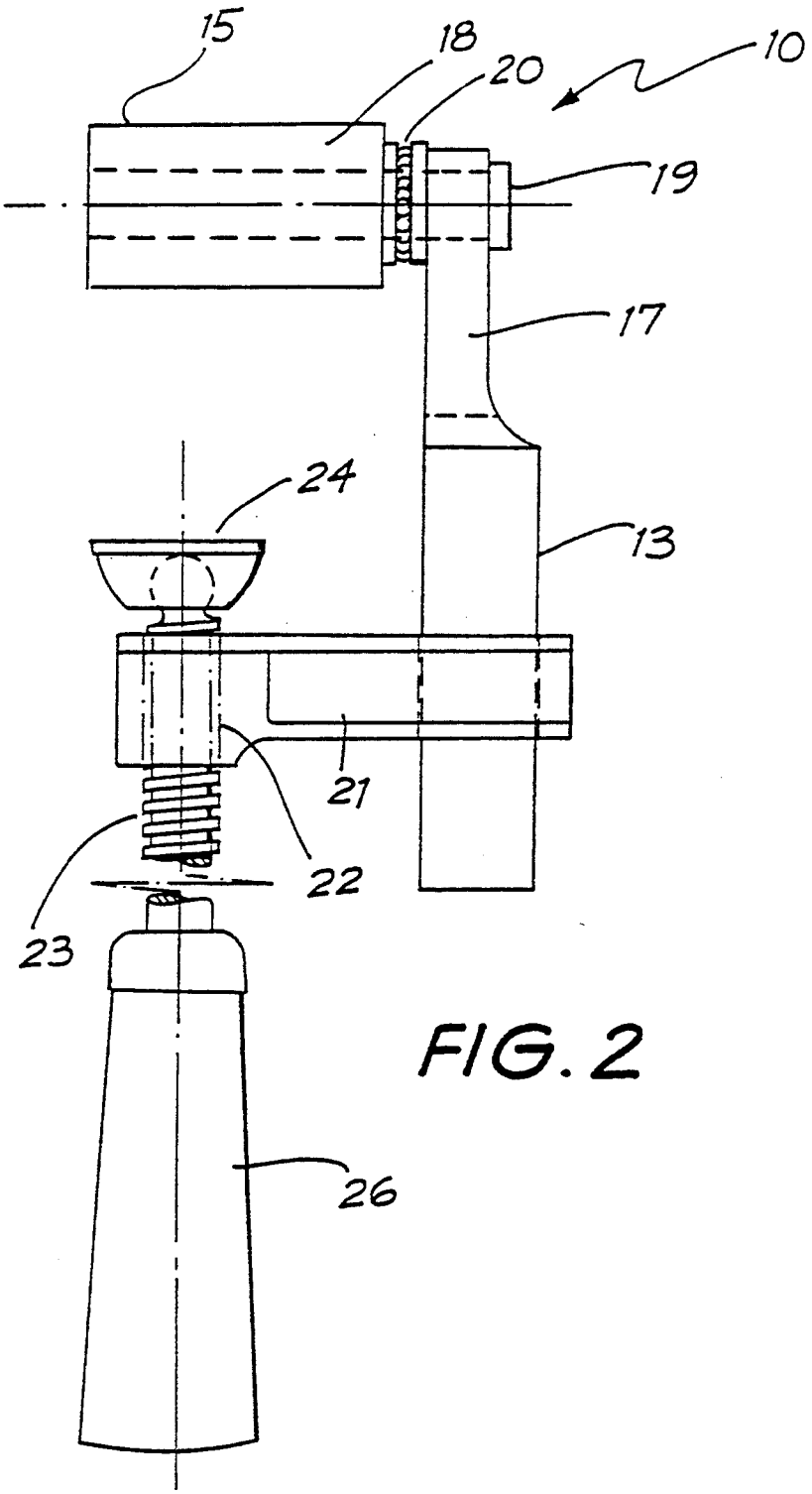
FIG. 2 is a side elevation of the clamp of FIG. 1.

As illustrated in FIGS. 1 and 2, a clamp 10 is provided and comprises first and second clamping members (11 and 12 respectively) interconnected by a shaft 13. The first clamping member 11 comprises two engaging elements 14 and 15 which are slidably mounted in respective slots 16 located in a support plate 17. The slots are arranged to converge at an upper end of the plate 17, remote from the second clamping member 12.

Each engaging element incorporates a head 18 which is rigidly connected to an axle 19 encaptured in the slots 16. In this way, each engaging element is free to slide in the respective slots while remaining mounted to the support plate 17.

Each engaging element is also free to rotate about its axle 19 through 360° relative to the support plate. To assist rotation of the engaging elements thrust bearings 20 are provided.

The second clamping member 12 comprises a bracket 21 which is secured to the shaft rod 13 and extends outwardly therefrom. A threaded hole 22 is located on the outer end of the bracket 21 and is arranged to receive a rod 23 having a corresponding thread on its outer surface. A plate 24 is connected to one end of the threaded rod 23 by way of a ball and socket assembly 25. A handle 26 is connected to the other end of the rod 23.

The second clamping member 12 is arranged such that rotation of the handle 26 imparts a linear movement to the plate 24 towards or away from the first clamping member 11.

The first clamping member 11 is arranged to be detachable from the shaft 13 by way of a dove tail connection 27.

Figure 3:
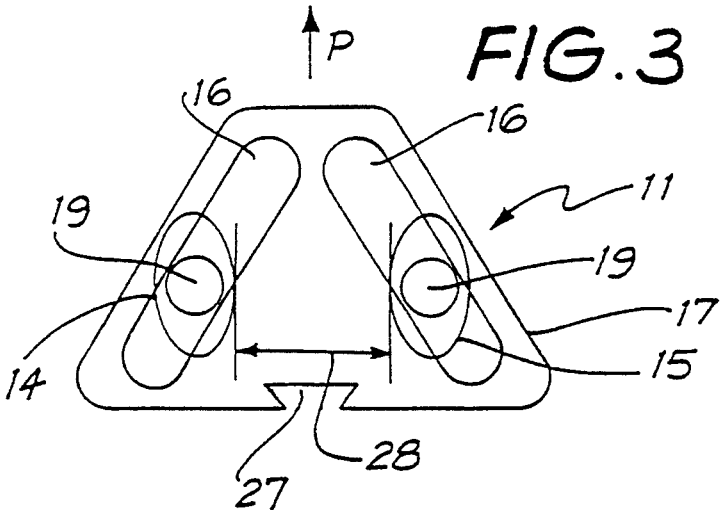
FIG. 3 is a front elevation of a clamping member embodying the present invention showing the engaging elements in a first position.
Figure 4:
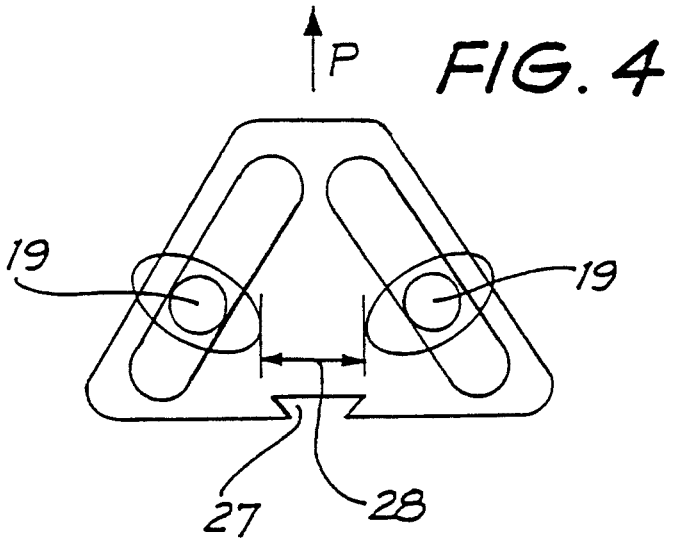
FIG. 4 is the clamping member of FIG. 3 showing the engaging elements in a second position.

FIGS. 3 and 4 illustrate the clamping action of the first clamping member 11.

The engaging elements 14 and 15 incorporate a gap 28 located therebetween and in use a work piece (not shown) is arranged to be located in the gap and held in position by the engaging elements 14 and 15.

As the slots 16 converge to the upper end of the support plate 17, and as each engaging element 14 and 15 is free to independently slide in its respective slots 16, rapid adjustment of the length of the gap is possible. Consequently, in use, a work piece is located in the gap 28 and each of the engaging elements are adjusted to bear against the surface of the work piece to be clamped.

Furthermore the engaging elements are shaped such that in any one position in the slots 16 the minimum distance of the gap 28 formed between the engaging elements 14 and 15 can decrease on the rotation of the elements from a first position as shown in FIG. 3 to a second position as shown in FIG. 4. This occurs because the radial distance from the centre of the axle 19 (which is the axis of rotation of the head 18) to the edge surface of the head is not constant and varies depending on which direction the radius is measured. In this way rotation of either of the engaging elements 14 or 15 causes a change in the radial distance from the axis of rotation to the edge surface 23, thus altering the minimum width of the gap 28. To enable this change of gap width to occur on rotation of the engaging elements, in the embodiment of FIGS. 1 to 4, the engaging elements are shaped as right oval cylinders.

When the engaging elements 14 and 15 are arranged to be initially located to bear against the work piece to be clamped, the engaging elements are arranged in the first position. Due to the frictional forces between the engaging elements and the work piece, any movement of the work piece in the direction of the arrow P will cause a corresponding force to be applied to the engaging elements 14 and 15. The magnitude of this force is dependent on the relative coefficient of friction between the two surfaces and as such is dependent on the surface characteristic of the engaging elements and the work piece. Furthermore, the magnitude of the force is dependent on the amount of force being applied by the engaging elements on the work piece in a direction normal to the contact surface.

Once this force is imparted to the engaging elements 14 and 15 by movement of the work piece in the direction of the arrow P a corresponding movement of the engaging elements 14 and 15 occurs. The first stage of this movement is that the engagement elements 20 are effectively dragged by movement of the work piece causing the engaging elements to slide in the converging slots 16 in the same direction as movement of the work piece. As the slots converge, the gap between the engaging elements become less and as such the force normal to the contact surface between the engaging elements and the work piece increases.

This sliding action continues until there is sufficient forces acting at the contact surface between the work piece and the engaging elements to cause the engaging elements to rotate. As the engaging elements rotate towards the second position from the first position, the lateral forces imparted by the engaging elements on the work piece increases until such time that it prevents further movement of the work piece in the direction P. At such time the work piece is securely clamped by the engaging elements.

As stated above, the initial force on the engaging elements imparted by movement of the work piece in the direction of the arrow P is dependent in part, on the coefficient of friction. Consequently, the engaging elements (14 and 15) have a non-slip material on their outer surface to ensure a relatively high coefficient of friction. Furthermore to protect the work piece from damage during clamping, the engaging elements are formed from a relatively flexible material. This flexible property results in an increased surface area at the points of contact with the work piece, especially under pressure, due to deformation of the material. The increased surface area at the contact points results in greater frictional forces between the work piece and the engaging elements.

Figure 5:
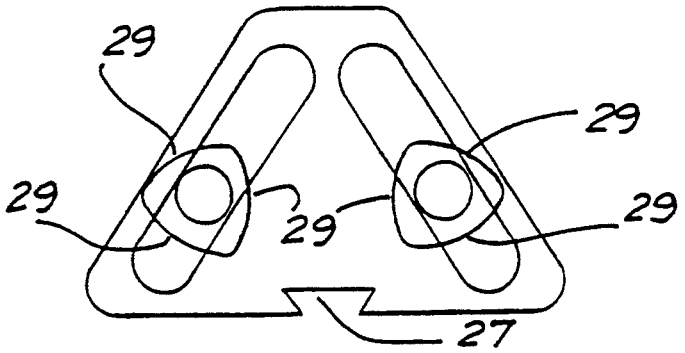
FIG. 5 is the clamping member of FIG. 3 incorporating an alternate form of engaging elements.

Alternative engaging elements (14, 15) are shown in FIG. 5 wherein the head 18 of the engaging elements are formed from modified right triangle prisms. To ensure that rotation of the head 18 from the first to the second position causes a reduction in the length of the gap, each face 29 of the right triangle prism has laterally curved faces in the direction of one lateral edge to the opposite edge. With using a head having such a shape, each lateral surface can be made from a different material having different hardness or grip characteristics.

To form the complete clamp 10, the second clamping 12 member is arranged to bear against the work piece located in the gap 28 to apply the force required to move the work piece in the direction of the arrow P. Once the engaging elements rotate to grip the work piece and prevent further movement of the work piece in the direction of the arrow P, the work piece is securely clamped by both the first and second clamping members.

In the embodiment as shown in FIGS. 1 and 2, the second clamping member 12 is able to impart this predetermined movement on the work piece by virtue of movement of the plate 24 towards the first clamping member 11.

Figure 6:
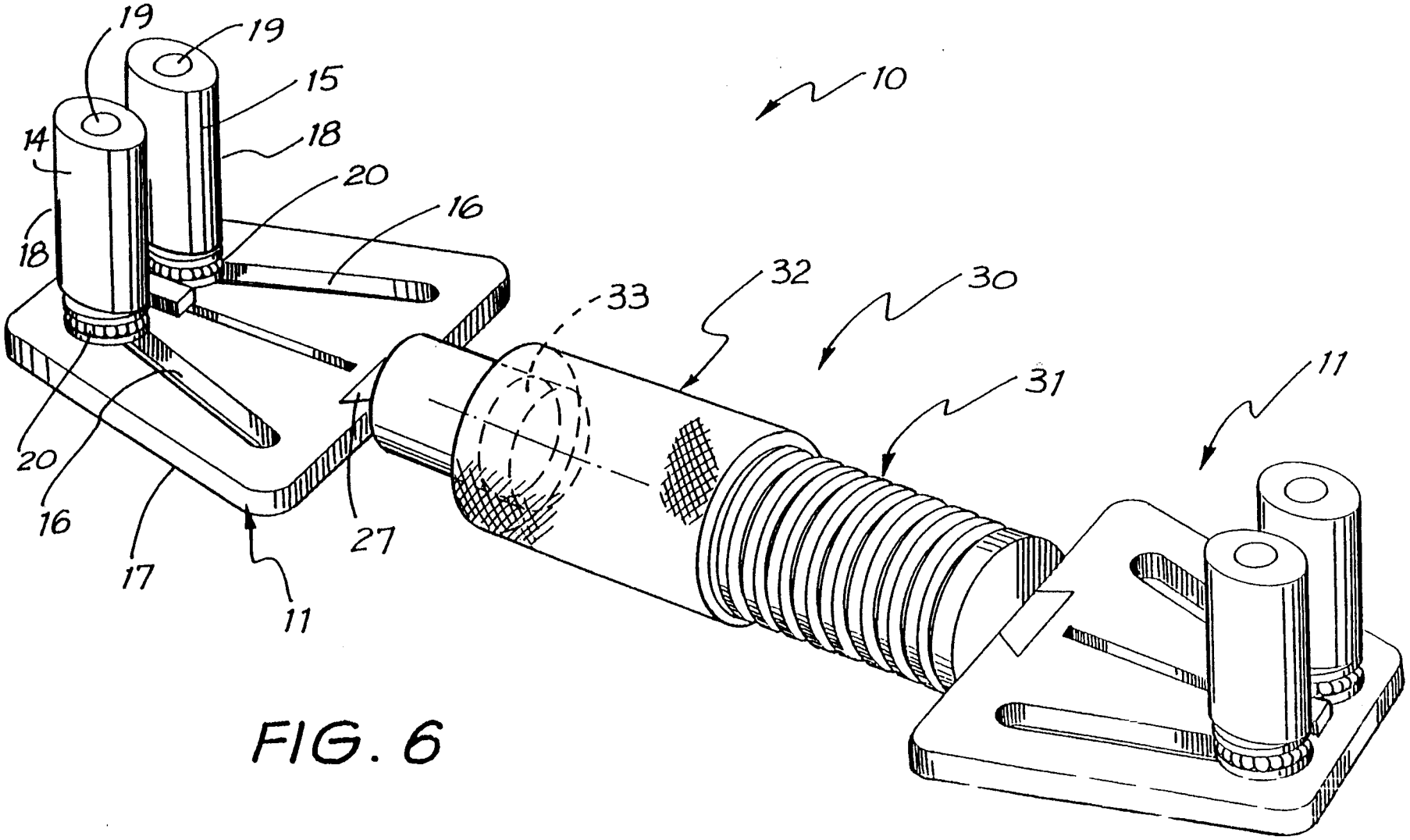
FIG. 6 is an alternate clamping arrangement incorporating two clamping members embodying the present invention.

A second embodiment is disclosed in FIG. 6 wherein two first clamping members (11, 11) as described above are interconnected to form the complete wood clamp. The action of each clamping member 11 is identical to that described above. In this arrangement the required predetermined movement of the work piece to enable clamping of both the clamping members is achieved by varying the distance between the two clamping members 11 and this is made possible by a coupling element 30 interconnecting the two clamping members. The coupling element 30 comprises a threaded rod 31 connected to one of the clamping members, and which 10 is received in a sleeve 32 having a corresponding threaded inner surface. The sleeve is connected to the other clamping member and is rotatable relative thereto by way of a thrust bearing 33. Rotation of the sleeve imparts relative linear movement between the two clamping members 11.

Figure 7:
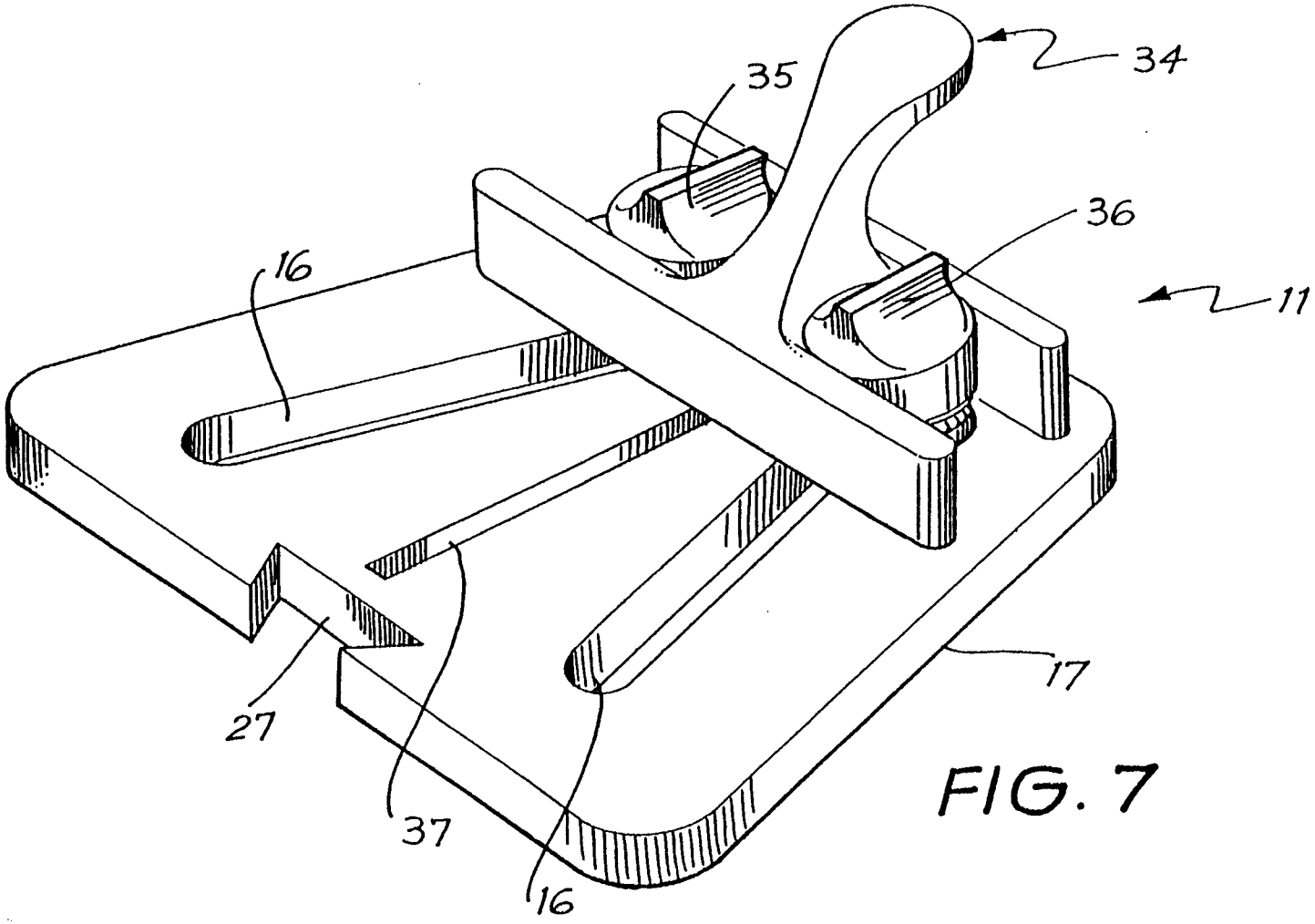
FIG. 7 is a bottom perspective view of a modified clamping member of FIG. 6 including a slide attachment.

FIG. 7 shows a further modification of the clamping member 11. The modification comprises a slide 34 which is adapted to contact an extension 35, 36 of each engaging element (14, 15) located on the rear face of the support plate 17. The slide 34 which consists essentially of a T piece enables simultaneous movement of the engaging elements (14, 15) to enable easy initial location of the engaging elements to bear against the work piece. Furthermore, if the surface characteristics of the work piece and the engaging elements are such that a fairly low coefficient of friction exists, the slide can be used to apply additional lateral pressure from the engaging elements onto the work piece to ensure that the engaging elements grip and rotate to clamp the work piece. To enable accurate location of the slide relative to engaging elements and the converging slots, the slide is movable in guide slot 37.

As will be apparent from the above description, the clamping members 11 enable a very versatile clamp to be realised. Furthermore, as the clamping members are all detachable, with the required parts the clamp can be converted from the embodiment shown in FIG. 1 and 2 to that shown in FIG. 6. Furthermore, the engaging elements 14 and 15 are all detachable from the clamping plate 17 such that engaging elements of different surface characteristics or of different shapes can be utilised. With the novel clamping action of the clamping member 11 the clamp in either embodiment can be used on a whole range of different shaped work pieces. Included in the type of work pieces which can be clamped are curved work pieces, T pieces and work pieces which are of considerable length and are required to be connected end to end.

I claim:

1. A clamping member comprising:

a support plate;

a pair of engaging elements each having a wall surface, at least a portion of the wall surface of each engaging element being arcuate in shape and being formed from a non-slop material, a pair of retaining means provided in the support plate, each respective one of the engaging elements being retained in a respective one of the retaining means such that each engaging element extends outwardly from a first side of the support plate so that the respective wall surfaces of the engaging elements are opposed to each other, each engaging element being slidable in its respective retaining means; and mounting means between each engaging element and the support plate such that each engaging element can freely rotate relative to the support plate about an axis of rotation, thereby enabling a distance between the opposing wall surfaces of the engaging elements to be varied by sliding the engaging elements in their respective retaining means, wherein the mounting means are low friction bearings and rotation of the engaging elements via the low friction bearings from a first position to a second position causes the distance between the opposing wall surfaces to be reduced.

2. A clamping member as claimed in claim 1, wherein the clamping member is arranged in use to clamp a work piece by locating the workpiece between the opposing wall surfaces of the engaging elements which are adjusted to contact the work piece in the first position, the work piece thereafter being moved in a direction along the support plate so as to cause the engaging elements to be biased to slide with the work piece such that the engaging elements apply additional pressure on the work piece, and that further movement of the work piece in the direction along the support plate causes rotation of the engaging elements to the second position wherein the engaging elements clamp the work piece and prevent further movement of the work piece along the support plate.

3. A clamping member as claimed in claim 2, wherein each engaging element is shaped such that it contacts a work piece along a substantial portion of its length extending outwardly from the first side of the support plate.

4. A clamping member as claimed in claim 1, wherein the engaging elements are oval shaped, in cross section perpendicular to their axis of rotation.

5. A clamping member as claimed in claim 1, wherein the engaging elements are shaped as modified right triangles in cross section perpendicular to their axis of rotation, the modified right triangles having laterally outward curved faces forming the arcuate portion of the wall surface, and wherein each laterally curved face has a different non-slip covering surface.

6. A clamping member as claimed in claim 1 wherein the engaging elements are formed from flexible, resilient material.

7. A clamping member as claimed in claim 1 wherein the engaging elements are detachable from the support plate.

8. A clamping member as claimed in claim 1, further comprising a guide arranged to contact the engaging elements and move the engaging elements in their respective retaining means without preventing rotation of the engaging elements relative to the support plate from the first to the second position, the engaging elements being adjusted by the guide to contact a work piece in the first position.

9. A clamping member as claimed in claim 8, wherein the pair of retaining means are a pair of converging slots on the first side of the support plate and converge about a central line.

10. A clamping member as claimed in claim 9, wherein the converging slots extend through from the first side to an opposite second side of the support plate, and each engaging element having a portion which extends outwardly from the second side of the support plate.

11. A clamping member as claimed in claim 7, wherein the guide is provided and is arranged to contact both engaging element portions extending outwardly from the second side of the support plate, the guide being arranged to move the engaging elements in their respective slots without preventing the engaging elements rotating relative to the support plate via the low friction bearings from the first to the second position.

12. A clamping member as claimed in claim 11, wherein the guide is mounted to the support plate to be slidable along said central line such that on movement of the engaging elements by said guide, a notional line interconnecting the axis of rotation of the engaging elements remains substantially perpendicular to said central line.

13. A clamping member as claimed in claim 8, wherein the guide is mounted to the support plate and is slidable along a central line such that on movement of the engaging elements by said guide, a notional line interconnecting the axis of rotation of the engaging elements remains substantially perpendicular to said central line.

14. A clamping member as claimed in claim 8 wherein each engaging element is shaped such that it contacts a work piece along a substantial portion of its length extending outwardly from the first side of the support plate.

15. A clamping member as claimed in claim 8 wherein the engaging elements are oval shaped, in cross section perpendicular to their axis of rotation.

16. A clamping member as claimed in claim 8 wherein the engaging elements are formed from flexible resilient material.

17. A clamping member as claimed in claim 8 wherein the engaging elements are detachable from the support plate.

18. A clamping member as claimed in claim 8 wherein the pair of retaining means are a pair of slots, the slots extending through from the first side to an opposite second side of the support plate and each engaging element also having a portion which extends outwardly from the second side of the support plate, wherein the guide is arranged to engage the engaging element portions which extend outwardly from the second side of the support plate.

19. A clamp comprising a first clamping member as claimed in claim 2 and a second clamping member connected to the first clamping member, the first and second clamping members being moveable relative to one another in a direction away or towards each other, wherein in use the second clamping member is arranged to abut the work piece and by relative movement of the first and second clamping members towards each other a force is imparted by the second clamping member on the work piece to move the work piece in a direction along the support plate of the first clamping member.

20. A clamp as claimed in claim 19, wherein the second clamping member comprises a bracket connected to the support plate, the bracket having a threaded aperture therein adapted to receive a rod having a corresponding thread on its outer surface, one end of the rod supporting a plate which is arranged to bear against the work piece, the second clamping member being arranged such that rotation of the rod enables relative movement of the plate of the second clamping member with respect to the first clamping member to enable movement of the work piece in the direction along the support plate of the first clamping member.

21. A clamp as claimed in claim 19 wherein the second clamping member also comprises a clamping member as claimed in claim 2, the first and second clamping members being interconnected by a shaft incorporating a coupling element which enables relative movement of the first clamping member with respect to the second clamping member in a direction away or towards each other.

22. A clamp as claimed in claim 21, wherein the coupling element comprises a rod having a thread on its outer surface which is arranged to be received in a sleeve having a thread on its inner surface, the rod being connected to the first clamping member and the sleeve being connected to the second clamping member, the sleeve being capable of rotation about its axis relative to the second clamping member and being arranged such that rotation of the sleeve causes linear movement of the first clamping member relative to the second clamping member.

23. A clamp as claimed in claim 19 wherein first clamping member is detachable from the second clamping member.

* * * * *